United States Patent [19]

Yoshiwara et al.

[11] 4,052,874

[45] Oct. 11, 1977

[54] METHOD OF PRODUCING TUBULAR BODY IN A PRESS ROLL PIERCING MILL

[75] Inventors: Seishiro Yoshiwara; Minoru Kawaharada; Samon Yanagimoto, all of Kitakyushu, Japan

[73] Assignee: Nippon Steel Corporation, Tokyo, Japan

[21] Appl. No.: 706,563

[22] Filed: July 19, 1976

[30] Foreign Application Priority Data

July 18, 1975 Japan ..... 50-88031

[51] Int. Cl.[2] ..... B21B 17/04

[52] U.S. Cl. ..... 72/209; 72/97; 72/368

[58] Field of Search ..... 72/97, 208, 209, 368

[56] References Cited

U.S. PATENT DOCUMENTS 3,391,561 7/1968 Calmes ..... 72/97 X

*Primary Examiner*—Milton S. Mehr

*Attorney, Agent, or Firm*—Wenderoth, Lind & Ponack

[57] ABSTRACT

A method of producing a cylindrical metallic tubular body in a press roll piercing mill. The method involves applying a pressing force to a polygonal metal billet in the axial direction thereof while guiding the billet by means of a guide during its advance, rolling corner portions of the billet to a certain degree with a pair of rolling rolls having semicircular grooves disposed above and below the billet prior to the contacting of a plug with the center of the front end surface of the billet, and successively piercing the billet by means of the plug while the billet is rolled, the tip portion the plug being retained on the pass center line by the rolling rolls.

1 Claim, 18 Drawing Figures

METHOD OF PRODUCING TUBULAR BODY IN A PRESS ROLL PIERCING MILL

BACKGROUND OF THE INVENTION

The present invention relates to a method for the manufacture of seamless metal pipe by piercing a polygonal billet in a press roll piercing mill.

Among conventional methods for piercing a billet to form a seamless metal pipe (for example, seamless steel pipe), the press roll piercing method and the cross roll piercing method are known, and recently, a review of such piercing methods has begun. The press roll piercing method is a method for manufacturing a hollow shell by inserting a round or polygonal billet into a container and forcing a mandrel against the billet from one end of the container to force the thus guided billet between the press rolls of the piercing mill and over a piercing plug. However, this method has lost its competitive position because of product quality and efficiency. The cross roll piercing method is the one most widely employed at present and among the variations of this method, the inclined roll piercing method is the most popular method. However, because of the severe working of the billet in this method, a high quality of rolled round billet is required.

SUMMARY OF THE INVENTION

An object of the present invention is to provide an extremely economical press roll piercing method which provides satisfactory bite of the rolling rolls on a polygonal billet, and does not require a plug guide hole in the center portion of the front end surface of the billet, and accordingly does not require machining of such a guide hole.

Another object of the present invention is to provide a press roll piercing method which greatly reduces the non-uniformity of the wall thickness of the formed hollow shell and accordingly the product yield is good, and a metal pipe of high quality can be manufactured.

The inventors have improved the press roll piercing method to a stage where it can be put into practical use by studies which have made it clear that the strain rate of the material is one-tenth to one-fiftieth that of the cross roll piercing method, and the strain in each direction is small, and accordingly, the generation of flaws is less frequent so that continuous cast polygonal cross-sectional bloom can be used as the billet for such a press roll piercing method.

The improved method for achieving the foregoing objects comprises applying a pressing force to a polygonal metal billet in the axial direction thereof while guiding the billet by means of a guide during its advance, rolling corner portions of the billet to a certain degree with a pair of rolling rolls having semicircular grooves disposed above and below the billet prior to the contacting of a plug with the center of the front end surface of the billet, and successively piercing the billet by means of the plug while the billet is rolled, the tip portion of the plug being retained on the pass center line by the rolling rolls.

DETAILED DESCRIPTION OF THE INVENTION

Figures 1A, 1B, 1C, 1D:
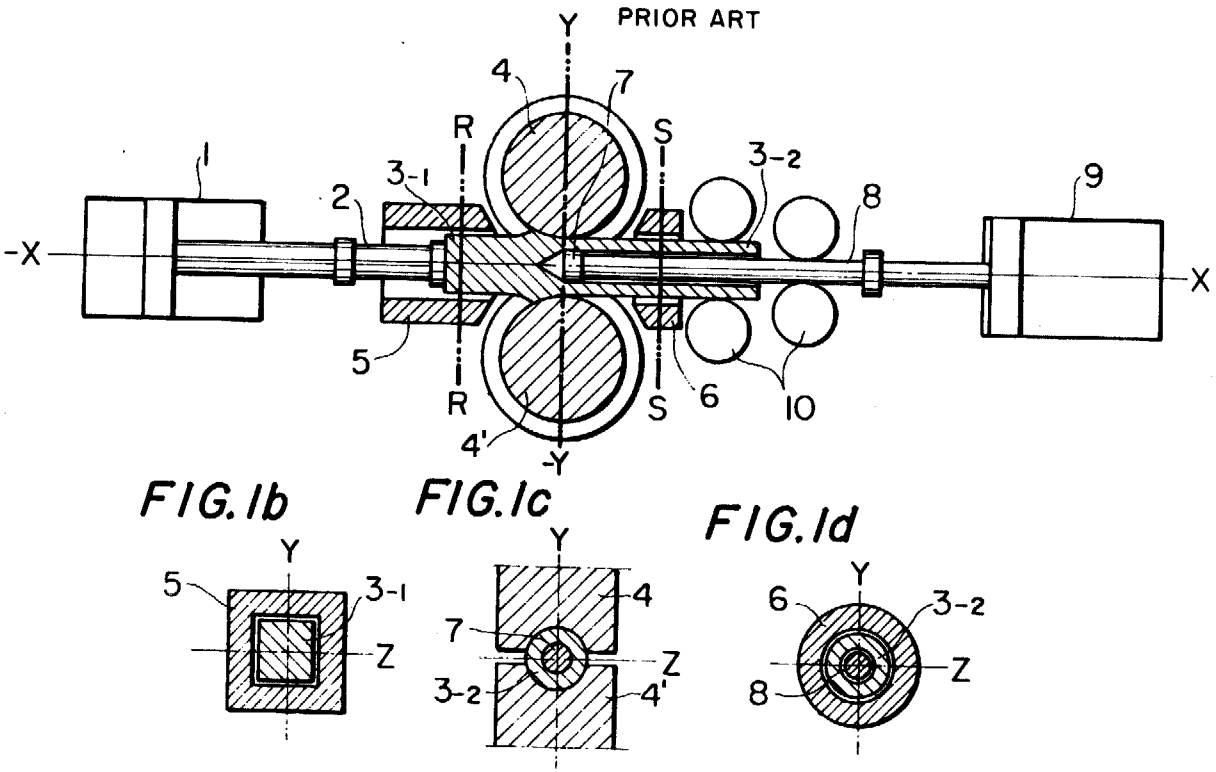
FIGS. 1(*a*), 1(*b*), 1(*c*), 1(*d*) are cross sections of a press roll piercing device for explaining the press roll piercing method, FIG. 1(*a*) being a cross section in the longitudinal direction of the press roll piercing device, and FIGS. 1(*b*), 1(*c*), 1(*d*) being cross sections along lines R—R, Y—Y and S—S of FIG. 1(*a*).

The press roll piercing method will first be explained in general with reference to FIGS. 1*a*–1*d*, in which a polygonal billet 3-1 is pushed between rolls 4 and 4', driven by a drive device (not shown), by means of a pusher rod 2 moved by a pushing piston-cylinder means 1. Ahead of and behind the rolls 4 and 4' are disposed an inlet guide 5 and an outlet guide 6 to keep the workpiece, namely the polygonal billet 3-1 and the hollow shell 3-2 rolled from the billet 3-1 on the mill center line —X—X.

The rolls 4 and 4' each have a peripheral groove therearound which has a semicircular cross-section, and a plug 7 is supported on the center line —X—Y of the pass formed by the two rolls 4 and 4' by means of a mandrel 8. During the rolling process the polygonal billet is advanced by the pushing force applied by the pushing cylinder 1 and the core portion of the billet is pierced and expanded by the plug 7, and the external surface of the billet is continuously rolled into a circular shape by the rolls. The working of the material of the billet is almost fully completed by the time the material of the billet reaches the roll center line —Y—Y. Behind the rolls 4 and 4' the hollow shell 3-2 and the mandrel 8 are guided by guide rolls 10.

The conventional press roll piercing method is characterized by the limitation that the billet having a square cross section is pushed against the piercing plug substantially at the same moment as it comes in contact with the roll groove.

Figure 2:
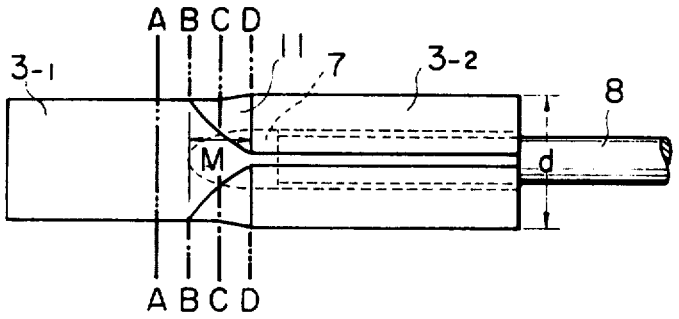
FIG. 2 PRIOR ART
FIG. 2 and FIGS. 3(*a*), 3(*b*), 3(*c*) and 3(*d*) are diagrams for explaining a conventional press roll piercing method, FIG. 2 showing the relationship between the condition in which rolling down of the polygonal billet is accomplished by the rolling rolls and the tip position of the plug and, FIGS. 3(*a*), 3(*b*), 3(*c*) and 3(*d*) being cross sections along lines A—A, B—B, C—C and D—D in FIG. 2.
Figure 3A:
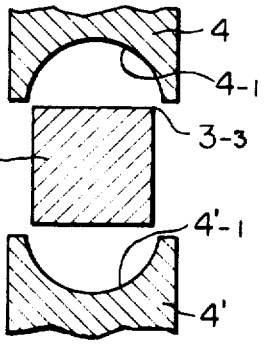
FIG. 3a PRIOR ART
Figure 3B:
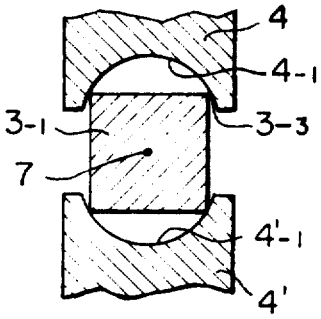
FIG. 3b PRIOR ART
Figure 3C:
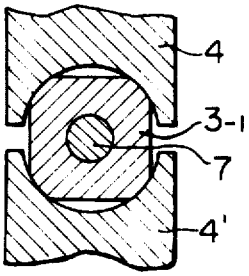
FIG. 3c PRIOR ART
Figure 3D:
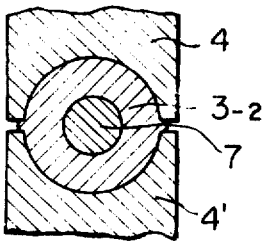
FIG. 3d PRIOR ART
Figure 7:
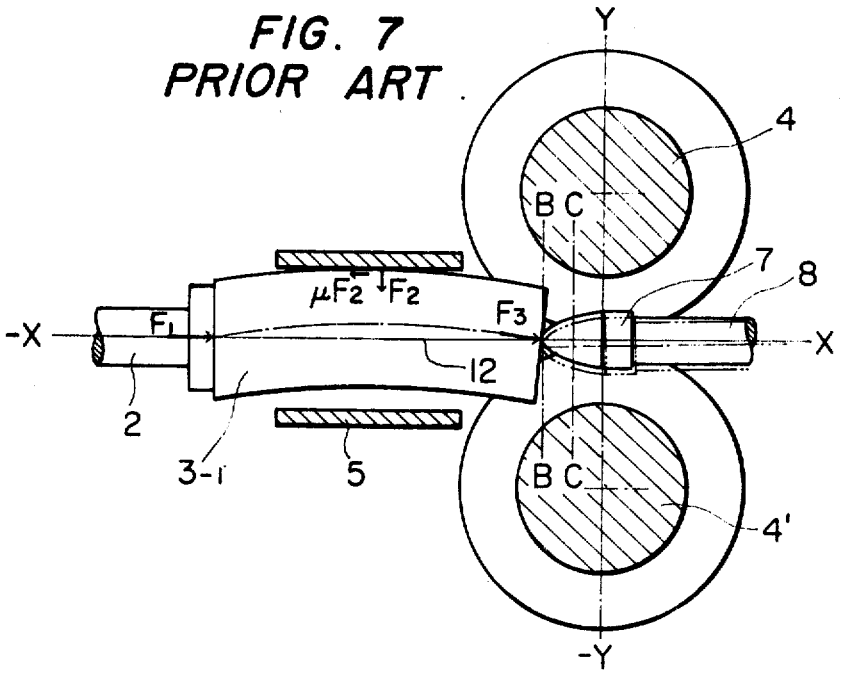
FIG. 7 PRIOR ART
FIG. 7 is a schematic sectional side view showing the condition where the tip of the plug is in contact with the front end surface of the billet in the conventional method.

The conventional method will be described in more detail with reference to FIGS. 2 and 3*a*–3*d*. In FIG. 2, line D—D coincides with line Y—Y in FIG. 1. As will be obvious from FIG. 3*a*, at the position of line A—A in FIG. 2, the billet 3-1 is not in contact with the rolls 4 and 4' at all, and has not yet contacted the plug 7. As shown in FIG. 3*b*, at the position of line B—B, the groove surfaces 4-1 and 4'-1 of the rolls 4 and 4' contact the corner portions 3-3 of the billet 3-1, and at the same time, the front end surface of the billet 3-1 contacts the tip of the plug 7. The contact of the billet with the plug 7 is indicated by a dot. As shown in FIG. 3*c*, at the position of line C—C, the working of the material of the billet has begun by the pressing down of the corner portions 3-3 of the billet and the piercing of the billet by the plug 7, and as seen in FIG. 3*d* at the position of line D—D, the billet 3-1 is rolled to almost a circular shape, and the piercing and rolling are almost completed, and the hollow shell 3-2 has been formed. As described in the foregoing, in FIGS. 2 and 3*a*–3*d*, at the position of line B—B, the billet almost simultaneously contacts the plug and the roll groove. This produces two disadvantages for the start of the piercing. The first disadvantage is the frequent occurrence of mis-bite (or engaging). As seen in FIG. 7, the front end surface of the billet 3-1 has just come in contact with the plug 7. But at this time, the billet 3-1 has just begun contacting the roll groove at the corners of the front end thereof and little or no advancing force is applied to the billet by the rolls. Thus the piercing is started only by the pressing force $F_1$. The magnitude of the force $F_1$ is sufficient to generate buckling of a long columnar billet 3-1, and if the billet buckles, it is pushed hard against the inner surface of the inlet guide 5. Where the pressing force is P and the coefficient of friction is $\mu$, a friction force $\mu F_2$ is generated, and said force $\mu F_2$ works in the opposite direction to the pressing force $F_1$. For this reason, when the piercing is started only with a pressing force $F_1$, the pressure force $F_1$ frequently exceeds the yield stress of the billet, and in such a case, the billet 3-1 bulges in the traverse direction, and increases the friction force between the billet and the guide 5.

On account of this phenomenon, a pressing force sufficient to start the piercing is not transmitted to the tip surface of the billet 3-1, and poor bite tends to occur. In order to overcome this problem, in the conventional method a countermeasure is taken to delay the generation of the reacting force of the plug at the bite until a force is generated by the rolls. A plug guide hole is provided in the surface at the leading end of the billet 3-1.

However, provision of the plug guide hole has an adverse side effect. The cooling rate of the front end surface of the billet 3-1 is greater than at the mid-portion thereof, so that the temperature of the tip portion at the time of the start of piercing is low, and as a result, the deformation resistance is increased. The increased deformation resistance increases the tendency for the pressing force $F_1$ to exceed the yield stress in the mid portion of the billet 3-1. The provision of the plug guide hole produces the adverse effect of further increasing the cooling rate at the front end of the billet.

The second disadvantage is that the non-uniformity of the wall thickness around the front end of the hollow shell 3-2 ( = { maximum wall thickness of the traverse cross section - minimum wall thickness } × 100 /average wall thickness (%)) increases greatly, and as a result, the uniformity of the wall thickness in the mid-portion also deteriorates because it is adversely influenced. Although it is possible to improve the uniformity of the wall thickness around the front end of the billet by providing a plug guide hole in the front end surface of the billet 3-1, such an improvement is not satisfactory from the industrial standpoint.

The inventors have discovered the following facts as the result of various reviews of the mechanisms causing the non-uniformity of the wall thickness of the tip portion and the mid-portion. In the conventional method, as shown in FIG. 7, at the start of piercing, the front end surface of the billet 3-1 contacts the tip of the plug 7 and simultaneously, its corner portions contact the grooves of the rolls 4 and 4'. This condition is similar to the condition shown in FIG. 3*b*. At this time, hardly any advancing force is applied to the billet 3-1 by the rolls, and the piercing must be started by the pressing force $F_1$ above. For this reason, as described in connection with the first disadvantage, the pressing force $F_1$ must be so large that it greatly exceeds the yield stress of the billet 3-1, and as a result, the billet 3-1 is bent easily, and a force $F_3$ inclined to the mill center line (12) is generated by the reacting force $F_2$ of the inlet guide 5, and the plug 7 and the mandrel 8 are forcedly bent as shown by broken lines in FIG. 7, and at the same time, the front end surface of the billet 3-1 is deformed irregularly. The facts that the front end surface of the billet is inclined to the roll center line —Y—Y of the pass due to the bend therein and that the flow of material is non-uniform due to the bend in the billet further aggrevate the foregoing situation. Namely, the flow of material is greater toward the upper side (Y direction) in FIG. 7, and is less toward the lower side (—Y direction), and the wall of the pipe on the upper side becomes thicker and the lower side becomes thinner. This tendency is not only greater in the vicinity of the front end of the billet, but also the bending of the plug and the mandrel by the front end portion is increased. Such tendencies are accelerated more and more during the piercing of the mid-portion and the rear end portion of the billet. Accordingly, in the foregoing conventional piercing method, it is necessary to provide a plug guide hole in the center of the front end surface of the billet, and even when the plug guide hole is provided, the length of the pierced hollow shell which can be produced is limited by the non-uniformity of wall thickness to less than 25 times the inside diameter of the hollow shell 3-2.

Figure 4:
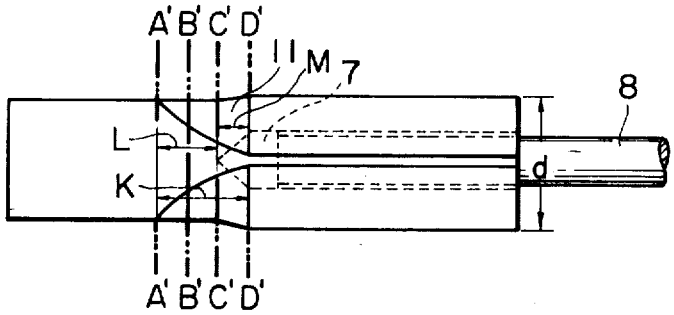
FIG. 4 and FIGS. 5(*a*), 5(*b*), 5(*c*) 5(*d*) are diagrams for explaining the press roll piercing method according to the invention, FIG. 4 showing the relationship between the condition in which rolling down of the polygonal billet is accomplished by the rolling rolls and the tip position of the plug and FIGS. 5(*a*), 5(*b*), 5(*c*) and 5(*d*) being cross sections lines A'—A', B'—B', C'—C' and D'—D' in FIG. 4.
Figure 5A:
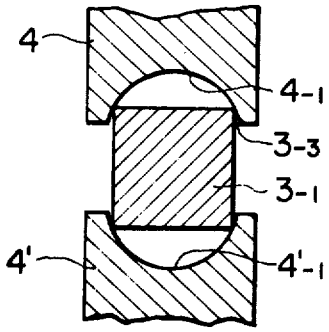
Figure 5B:
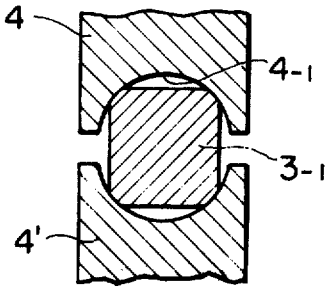
Figure 5C:
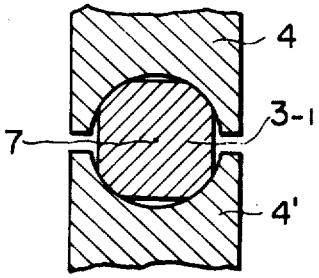
Figure 5D:
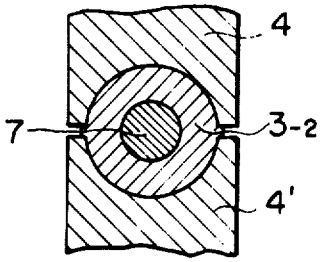
Figure 6:
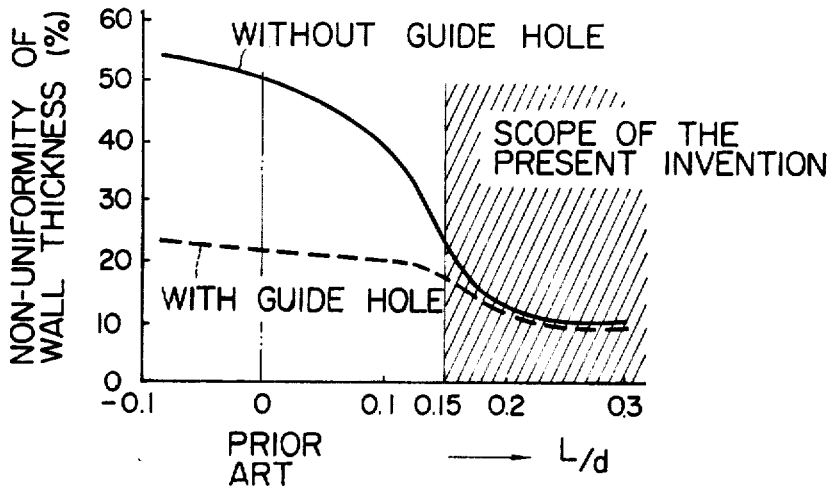
FIG. 6 is a graph showing the improvement in the non-uniformity of the wall thickness of the pipe rolled by the method of the present invention in comparison with the non-uniformity of wall thickness of the pipe rolled by the conventional method.

The graph of FIG. 6 shows the relationship of the uniformity of the wall thickness of the hollow shell at a position at a distance *d* (*d* is the outside diameter of the pipe) from the front end of the billet and the value L/*d*, obtained by dividing the distance L (= the projection K of the maximum contact arc length of the rolls and the material — the distance M from the center line of the rolls to the tip of the plug — see FIG. 4) by the outside diameter *d* of the pipe. In the conventional press roll method K and M are equal so that L/d = 0, and the non-uniformity of wall thickness where no guide hole is provided is 50%. Even with the guide hole, the non-uniformity of wall thickness is limited to 22%, and when the guide hole is not provided, the yield of the pipe deteriorates greatly. It is extremely difficult to machine the guide hole without spoiling the shape of the billet when it is in the hot forming condition, and it is best if it is fabricated by cold forming. Where a length of a workpiece 2–3 times the length which can be pierced is heated before rolling and it is cut into piercing lengths before the piercing, a guide hole cannot be fabricated sometimes. Even if the guide hole is fabricated while the billet is in the hot forming condition, its dimensional accuracy is poor, a sufficiently good effect cannot be obtained and also, because the end surface is deformed, it cannot easily pass through the inlet guide 5. If the clearance between the billet and the inlet guide 5 is made too great, the billet 3-1 will not be kept in the pass center, and the non-uniformity of the wall thickness increases which is disadvantageous.

The present invention overcomes the foregoing drawbacks. The inventors have confirmed the following matters through experiments.

1. Unless the tip portion of billet is advanced accurately to a point at least just before the plug 7 on the center axis —X—X even if the plug 7 together with the mandrel 8 are retained on the center axis by means of the guide rolls 10, the plug 7 and the mandrel 8 are forcedly bent by the billet and as a result, the center of the billet cannot be pierced into a uniform wall thickness.

2. Unless the billet is retained firmly on the incoming side, even if the billet is advanced on the center axis —X—X the billet end portion is deformed irregularly by the pressing force applied at the time of piercing the billet by means of the plug, and becomes eccentric, and also at the same time, an eccentric load is applied on the plug 7 by the bend in the billet generated by the pressing force and a force inclined to the mill center line generated as the result of said bend and thus the mandrel is forcedly bent, and non-uniformity of the wall thickness is generated.

3. In order to retain the billet firmly on the center axis —X—X ahead of the plug, it is best to retain the billet by the rolling action on the corner portions thereof by means of the rolling rolls. Namely, when the billet is bent due to the pressing force pressing the billet against the plug and a force inclined to the mill center line generated by said bend is applied to the plug as an eccentric load, sufficient counteracting effect cannot be achieved when only the inlet guide is used.

Now, the present invention will be described in detail with reference to FIG. 4 and FIGS. 5(*a*), 5(i b), 5(*c*) and 5(*d*). FIG. 5(*a*) corresponding to the position at line A'—A' in FIG. 4 shows the instant when the groove surfaces 4-1 and 4'-1 of the rolling rolls 4 and 4' contact the corner portions 3—3 of the billet 3-1, and in the conventional method, as shown in FIG. 3*b*, at this instant, the tip of the plug 7 contacts with the front end surface of the billet 3-1. FIG. 5(*b*) corresponding to the position at line B'-B' in FIG. 4 shows the condition where the rolling of the corner portions 3—3 has advanced slightly, and yet the tip of the plug 7 has still not been contacted by the front end surface of the billet 3-1. FIG. 5(*c*) corresponding to the position at line C'—C' in FIG. 4 shows the instant at which the tip of the plug 7 is contacted by the front end surface of the billet 3-1. At this time, the billet 3-1 is firmly retained by the rolling rolls 4 and 4' so that the axis thereof coincides the pass center line. FIG. 5(*d*) corresponding to the position at line D'—D' in FIG. 4 shows the condition in which the billet 3-1 is rolled into almost circular shape and the piercing is almost completed and the hollow shell 3-2 is formed.

In FIGS. 4 and 5*a*-5*d*, where L = the projected maximum contact are length K of the material — the distance M from the center line of the rolls to the tip of the plug projecting into the incoming side, the roll biting point A'—A' is located ahead the plug 7, and is separated by the distance represented by L from the tip of the plug. Before the billet is advanced to the position of the plug 7, the corner portions are sufficiently retained and rolled by the rolls whereby even if there is no guide hole, and provided that the plug 7 is present in the pass center, the center of the front end surface of the billet and the center of the plug coincide, and the bend of the billet generated by the pressing force and the force inclined to the mill center line resulting from the bend are directed in the direction of the mill center line at a point just before the plug by means of the rolling force, whereby the uniformity of wall thickness in the vicinity of the front end portion is improved.

Figure 8:
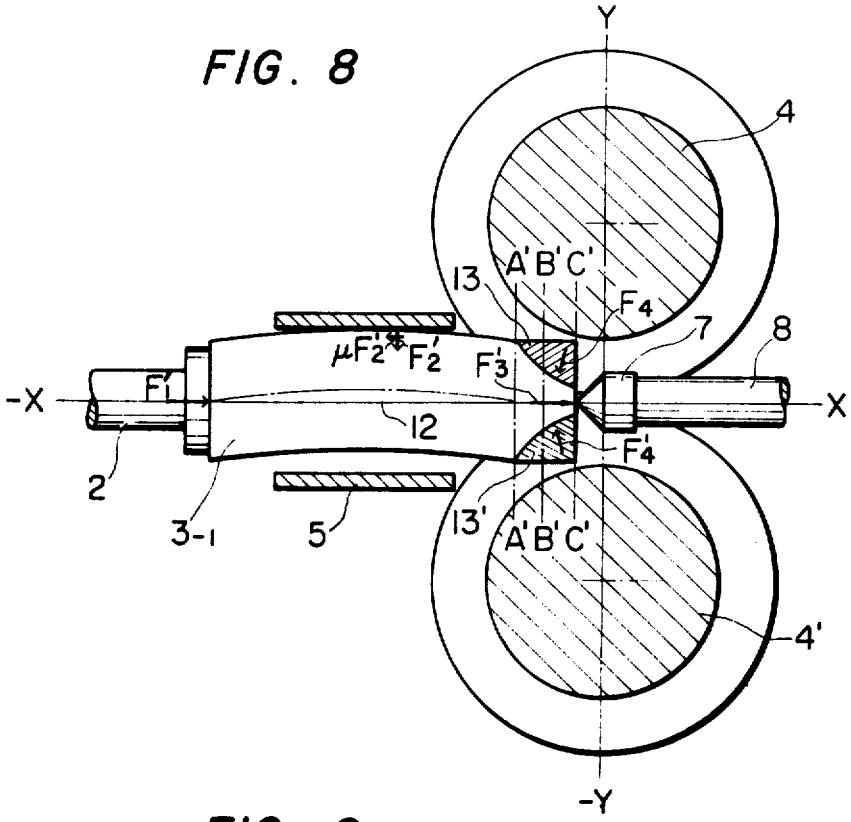
FIG. 8 is a view similar to FIG. 7 showing the condition where the tip of the plug is in contact with the front end surface of the billet in the method of the present invention.

This is shown in detail in FIG. 8 showing the case where the tip of the plug 7 is contacted by the front end surface of the billet 3-1 according to the present invention, but at this time, the corner portions in the vicinity of the front end of the billet 3-1 are being rolled by means of the roll groove, and the shaded portions indicated by 13 and 13' in the drawing are in contact with the rolls. By holding and rolling the billet 3-1 before the plug 7 is contacted as described in the foregoing, the two disadvantages of the conventional method can be eliminated. Namely, the mis-bite can be eliminated by adding to the pressing force $F_1$ the advancing force generated when the corner portions of the billet are rolled by the rolling rolls 4 and 4' which are driven by a motor (not shown). The magnitude of the advancing force generated by the rolls is slightly smaller than the rolling load at this time, but it is a force having a magnitude sufficient to assist the bite with the plug. The second problem of non-uniformity of wall thickness is improved in the present invention as follows. Namely, in the conventional method, the force $F_3$ which is inclined to the mill center line —X—X working on the tip of the plug as the resultant force of the pressing force $F_1$ and the reacting force $F_2$ of the inlet guide becomes a force $F_3$ which is directed in the direction of line —X—X by the rolling forces $F_4$ and $F_4'$ just ahead the plug in the present invention as shown in FIG. 8, and the bend of the billet is corrected by the holding and rolling of the billet, the corner portions of which are retained firmly by the rolls. For this reason, the axis of the billet 3-1 just ahead of the plug coincides with the axis of the plug 7 which is on the mill center line —X—X, and the hole begins to form in the center portion, and the flow of the material is not in an inclined direction relative to the axis, and as a result, non-uniformity of wall thickness is not generated.

As described in the foregoing, basically, the larger the value of $L/d$, the better the biting becomes, and the non-uniformity of wall thickness is reduced.

Figure 9:
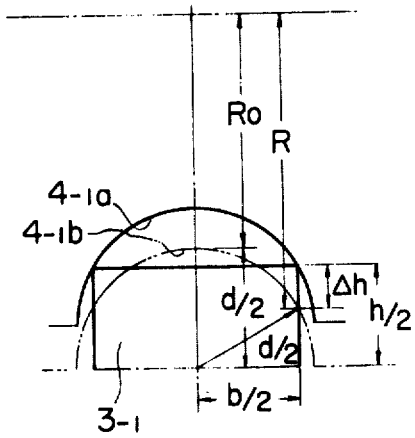
FIG. 9 is a diagram showing the relationship between the billet and groove of the rolling rolls and for explaining the rolling reduction.

FIG. 6 shows the relationship between $L/d$ and non-uniformity of wall thickness for the present invention. $L/d = 0$ shows that the biting point with the rolls and the tip of the plug are at the same positions in the conventional technique, and $L/d < 0$ shows that the biting point is on the outgoing side of the roll pass from the tip of the plug, and $L/d > 0$ shows that the biting point is on the incoming side of the roll pass from the tip of the plug. As $L/d$ becomes bigger, the uniformity of wall thickness at a position at distance $d$ from the front end of the workpiece is gradually improved, and the uniformity of wall thickness begins to improve when $L/d = 0.15$ regardless of whether a guide hole is provided or not. The value of non-uniformity of wall thickness for the product produced by a press roll piercing process below which there is no longer a problem with the finished product is about 25%, and this value is achieved for $L/d \leqq 0.15$. This value of $L/d$ is the point where the effect of the present invention appears clearly, and also where the non-uniformity of wall thickness becomes less than 25%. Where $L/d > 0.15$, the corner portions of the billet are rolled to such an extent that the bending of the tip portion of the billet by the pressing force is prevented and the billet can be retained in the pass center by means of the rolling rolls. The value $L/d$ can be represented by the following with the diameter of the groove ($d$ = diameter of the pipe), bottom radius of the roll groove ($Ro$), the height $h$ of the billet, the width $b$ of the billet, and the distance M from the center of the rolls to the tip of the plug projecting into the incoming side where a square billet is rolled by means of a circular pass. In FIG. 9, 4-1*a* shows the contour of the roll groove at the position of line A'—A' in FIG. 4 and 4-1*b* at the position of line D'—D' in FIG. 4.

In case of a rectangular billet, the portions that contacts the roll groove in the first instance are the corner portions as will be obvious from FIG. 5(*a*). In FIG. 9, the roll radius $R$ corresponding to the position is $$R = Ro + \frac{d}{2} - \sqrt{\left(\frac{d}{2}\right)^2 - \left(\frac{b}{2}\right)^2} \quad (1)$$

The one side rolling reduction $\Delta h$ at the position is $$\Delta h = \frac{h}{2} - \sqrt{\left(\frac{d}{2}\right)^2 - \left(\frac{b}{2}\right)^2} \quad (2)$$

The projection roll contact arc length $K$ of the portion is $$K = \sqrt{2R\,\Delta h - \Delta h^2} \approx \sqrt{2R\,\Delta h} \quad (3)$$

also, $$L - K - M \quad (4)$$

Accordingly, from the equations (1), (2), (3), (4), $$\frac{L}{d} = \frac{1}{d}\left\{\sqrt{2\left\{R_o + \frac{d}{2} - \sqrt{\left(\frac{d}{2}\right)^2 - \left(\frac{b}{2}\right)^2}\right\}\left\{\frac{h}{2} - \sqrt{\left(\frac{d}{2}\right)^2 - \left(\frac{b}{2}\right)^2}\right\}} - M\right. \quad (5)$$

In case the billet has a polygonal shape, or in case the groove shape is not circular, it is possible to obtain the value $L/d$ by a similar method.

As described in the foregoing, the value $L/d$ can be determined by $Ro$, $d$, $b$, $h$, and M, but the interrelation with the non-uniformity of the wall thickness is extremely clear, and the accuracy is high as compared with other methods, and it can be easily calculated. With respect to the conditions causing non-uniformity of wall thickness, it is possible to analyze this condition in terms of the roll retaining force for retaining the billet, but the quantization of this relationship is difficult.

Furthermore, it is possible to analyze this condition in terms of the relationship with the roll contacting area of the portion, but it is accompanied by an error based on an assumption in the calculating process for the area, and the interrelation with the non-uniformity of wall thickness is inferior to the relationship $L/d$. The variables in the equation (5) set forth above have the following scopes as far as practical conditions are concerned. Namely, $$2.5 \leqq Ro/d \leqq 8 \quad (6)$$
$$0.7 \leqq b/d \leqq 0.96 \quad (7)$$
$$0.7 \leqq h/d \leqq 1.2 \quad (8)$$
$$0 \leqq M \leqq d \quad (9)$$

The basis for the lower limits and the upper limits is as follows. The equation (6) limits the roll diameter, and the lower limit brings about a drop in the bite and a reduction in the roll strength, brings about the drop of bite and shortage in the roll strength, and the upper limit brings about excessive torque and roll size which are not satisfactory. The equation (7) the lower limit of which is for filling the pass with material and the upper limit is to prevent over fill from being fatal. The lower limit of the equation (8) is set so as to cause the material to fill the pass, and its upper limit is to make sure that the bite angle is not so excessive as to interfere the bite. And the lower limit of the equation (9) is set so that the rolling according to the present invention is nearly completed on the center line of the rolls. In case $M < 0$, namely, the expansion of the inside diameter exceeds the distance of the rear part from the center of the rolls, the occurrences of the non-uniformity of wall thickness, inferiority of the shape of the external surface and occurrences of split type flaws increases. The upper limit of the equation (9) is set so as to reduce the cost of the plug. Each factor is set so that in the scope of the equations (6), (7), (8) and (9), particularly, in equation (5), the bigger the values of $Ro$, $b$, $h$, the larger the value $L/d$ is, and the smaller $d$, $M$, the larger $L/d$.

With respect to the shape of the plug, such shape is briefly illustrated in FIGS. 1, 2, 4, but with the use of a proper shape such as a flat tip surface shape, a similar effect can be obtained. Also, the diameter of the guide hole was $0.125d$.

There was no reduction in the quality of the pipe when the value $L/d \leqq 0.15$. With respect to the upper limit of the value of $L/d$, it is about 0.4 from the standpoint of design and installation of the normally employed piercing machine. The plug guide hole of the billet becomes unnecessary when using the process of the present invention, and the bite becomes easier, and not only the uniformity of the wall thickness in the vicinity of the front end but also the uniformity of the wall thickness in the mid portion becomes satisfactory from the influence of the improved uniformity in the vicinity of the front end. In this embodiment, a polygonal billet is understood to mean a billet having a cross section which is almost square or rectangular, but if the corner portions are slightly chamferred, or there is a slight irregularity in the side portions there is no problem, and other polygonal billets can also be worked on by the method according to this invention. Also, in the present invention, it is possible to use a plurality of driven or non-driven guide rolls as guide means for the inlet side of the piercing machine.

In one embodiment of the present invention, the piercing was performed with the use of rolls having a diameter of 420 mm, a roll gap of 4 mm, a pass diameter of 94.1 mm $\phi$, and (1) L = 14 mm, and $1/d$ — 0.15 and (2) L = 28 mm and $L/d$ = 0.3, with results of non-uniformity of wall thickness = 22% and 12% compared to the non-uniformity of wall thickness = 51% in the conventional technique without using a guide hole.

In case more than two rolls or polygonal cross section billets are used, or in case the workpiece is non-ferrous metal, similar effects can be obtained.

What is claimed is

1. In a method for producing a cylindrical metallic tubular body by rolling a polygonal billet in a press roll piercing mill, the improvement comprising:

first causing only the rolls of the press roll piercing mill to roll the front end of the billet prior to contact the center portion of the front end of the billet with the tip of the piercing plug for preventing bending of the billet by the pressing force and maintaining the axis of the billet on the pass center line; and bringing the front end of the billet into contact with the piercing plug of the press roll piercing mill to begin the piercing operation on the pass center line only after the billet has moved into the pass a distance at least 0.15 times the outside diameter of the rolled tubular body from the point of the start of rolling of the front end of the billet by the rolls of the press roll piercing mill, whereby non-uniformity of the wall thickness of the hollow shell is reduced to no more than 25%.

* * * * *